US008026676B2

(12) United States Patent
Liu et al.

(10) Patent No.: US 8,026,676 B2
(45) Date of Patent: Sep. 27, 2011

(54) DIMMING CONTROL CIRCUIT

(75) Inventors: Jing-Meng Liu, Jubei (TW); Chiawei Liao, San Jose, CA (US); Leng-Nien Hsiu, Jubei (TW)

(73) Assignee: Richtek Technology Corporation, R.O.C. (TW)

( * ) Notice: Subject to any disclaimer, the term of this patent is extended or adjusted under 35 U.S.C. 154(b) by 376 days.

(21) Appl. No.: 12/327,830

(22) Filed: Dec. 4, 2008

(65) Prior Publication Data

US 2010/0084991 A1 Apr. 8, 2010

Related U.S. Application Data

(63) Continuation-in-part of application No. 12/287,314, filed on Oct. 8, 2008.

(51) Int. Cl.
*G05F 1/00* (2006.01)
*H05B 37/00* (2006.01)

(52) U.S. Cl. ..... 315/291; 315/312

(58) Field of Classification Search ..... 315/291, 315/307, 224, 312; 362/800
See application file for complete search history.

(56) References Cited

U.S. PATENT DOCUMENTS

| | | | | |
|---|---|---|---|---|
| 5,952,793 | A * | 9/1999 | Nishi et al. | 315/307 |
| 6,445,143 | B1 * | 9/2002 | Min | 315/307 |
| 7,358,685 | B2 * | 4/2008 | Lee | 315/287 |
| 7,667,408 | B2 * | 2/2010 | Melanson et al. | 315/209 R |
| 7,804,256 | B2 * | 9/2010 | Melanson | 315/291 |
| 2008/0055230 | A1 * | 3/2008 | Jang et al. | 345/102 |
| 2009/0140666 | A1 * | 6/2009 | Liao et al. | 315/291 |

* cited by examiner

*Primary Examiner* — Douglas W Owens
*Assistant Examiner* — Minh D A
(74) *Attorney, Agent, or Firm* — Tung & Associates

(57) ABSTRACT

The present invention discloses a dimming control circuit, comprising: an input terminal for receiving an input signal; an analog and digital dimming circuit receiving the input signal, wherein the analog and digital dimming circuit provides an analog dimming function when a voltage level of the input signal is between a predetermined lower limit and a predetermined upper limit, and a digital dimming function when the voltage level of the input signal switches above and below the predetermined lower limit, and wherein the analog and digital dimming circuit generates an analog signal when the voltage level of the input signal is above the predetermined lower limit; and a power circuit for supplying an output current in correspondence to the analog signal generated by the analog and digital dimming circuit.

20 Claims, 6 Drawing Sheets

DIMMING CONTROL CIRCUIT

CROSS REFERENCE

This application is a continuation-in-part application of U.S. Ser. No. 12/287,314, filed on Oct. 8, 2008.

BACKGROUND OF THE INVENTION

1. Field of Invention

The present invention relates to a dimming control circuit capable of providing analog dimming, digital dimming and enable functions by one single pin. The circuit may be used in, e.g., an LED driver circuit.

2. Description of Related Art

As shown in FIG. 1, a typical prior art method for controlling LED brightness is to control the average current flowing through the LEDs (light emitting diodes) by the duty ratio of a digital dimming signal 101.

However, it is required to adjust the LED brightness in an analog manner in certain products. Under such circumstance, the analog input can only adjust the brightness, but can not provide any other function, nor can it provide any digital function. For example, if it is intended to adjust the LED brightness in the analog manner, and it is also desired to provide an enable function (e.g., to turn ON/OFF the LEDs), it is then required to provide both an analog input pin and a digital input pin EN, and corresponding circuits, to the driver circuit 10 shown in FIG. 1, which is obviously not cost-effective.

In view of the above, the present invention proposes a device and a method which is capable of generating analog and digital signals according to one input signal, to achieve a composite function of, e.g., dimming and ON/OFF control.

SUMMARY OF THE INVENTION

A first objective of the present invention to provide a dimming control circuit.

Another objective of the present invention to provide a method and device for generating analog and digital signals according to one input signal.

In accordance with the foregoing and other objectives, and from one aspect of the present invention, a dimming control circuit comprises an input for receiving an analog control signal; a digital dimming circuit for receiving the analog control signal and generating a digital signal; an analog dimming circuit for receiving the analog control signal and generating an analog signal; and a power circuit enabled by the digital signal for converting a supply voltage to an output voltage according to the analog signal generated by the analog dimming circuit.

From another aspect of the present invention, a method for generating analog and digital signals according to one analog control signal comprises: receiving an analog control signal; generating a digital signal according to the analog control signal; and generating an analog signal according to the analog control signal.

Preferably, the method further comprises: driving a subject circuit by the analog signal generated according to the analog control signal; and enabling the subject circuit by the digital signal generated according to the analog control signal.

Preferably, the method further comprises: supplying power by the subject circuit.

From yet another aspect of the present invention, a device for generating analog and digital signals according to one analog control signal comprises: an input for receiving an analog control signal; a first circuit for generating a digital signal according to the analog control signal; and a second circuit for generating an analog signal according to the analog control signal.

Preferably, the device further comprises a third circuit which is enabled by the digital signal generated by the first circuit and operates according to the analog signal generated by the second circuit. Preferably, the third circuit includes a power circuit supplying power to light emitting devices.

In a further aspect of the present invention, a dimming control circuit comprises: an input terminal for receiving an input signal; a digital dimming circuit for receiving the input signal and generating a digital signal; an analog dimming circuit for receiving the input signal and generating an analog signal; and a power circuit for converting a supply voltage to an output voltage according to the analog signal generated by the analog dimming circuit.

Preferably, the digital dimming circuit provides a soft start control function. In one embodiment, the digital dimming circuit includes: a first comparator comparing the input signal with a first reference voltage; a soft start device generating a voltage at a node which is electrically connected with the output of the first comparator; and a second comparator comparing the voltage at the node with a second reference voltage and outputting a first enable signal.

In one embodiment, the soft start device includes a current source and a capacitor charged by the current source to generate the voltage at the node, for providing a soft start signal. When the input signal is below the first reference voltage, the capacitor discharges to decrease the voltage at the node.

In yet another aspect of the present invention, a dimming control circuit comprises: an input terminal for receiving an input signal; an analog and digital dimming circuit receiving the input signal, wherein the analog and digital dimming circuit provides an analog dimming function when a voltage level of the input signal is between a predetermined lower limit and a predetermined upper limit, and a digital dimming function when the voltage level of the input signal switches above and below the predetermined lower limit, and wherein the analog and digital dimming circuit generates an analog signal when the voltage level of the input signal is above the predetermined lower limit; and a power circuit for supplying an output current in correspondence to the analog signal generated by the analog and digital dimming circuit.

Preferably, in the above dimming control circuit, the predetermined lower limit is higher than zero.

Preferably, the dimming control circuit further comprises a delay circuit for generating a delayed shut down signal after a predetermined period of time from when the input signal stays below the predetermined lower limit.

Preferably, the dimming control circuit further comprises a soft start control circuit which begins or restarts to disable a soft start function when the input signal switches above the predetermined lower limit, and resumes the soft start function when the input signal is below the predetermined lower limit for a predetermined period of time.

These and other features, aspects, and advantages of the present invention will become better understood with reference to the following description of preferred embodiments and accompanying drawings.

DESCRIPTION OF THE PREFERRED EMBODIMENTS

Figure 1:
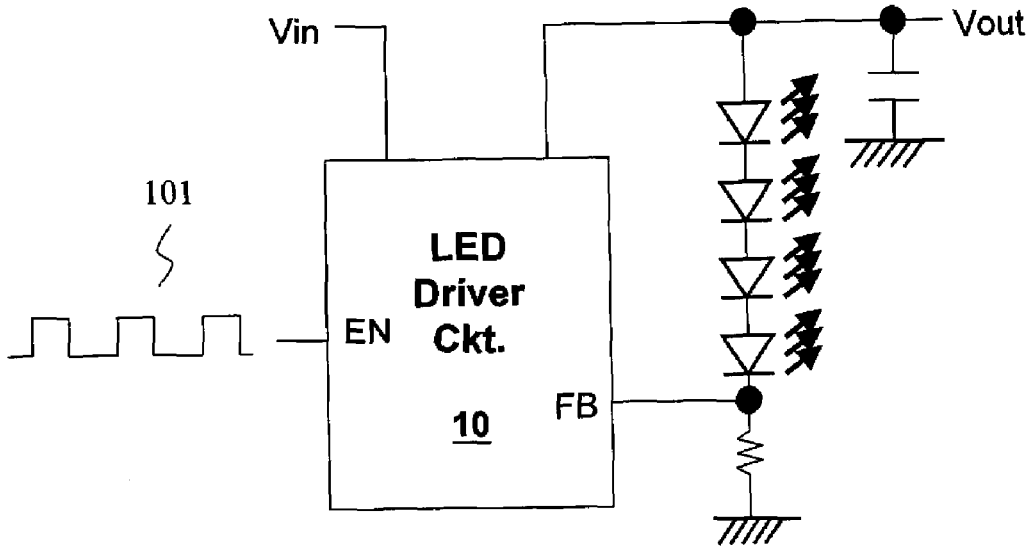
Fig. 1 (Prior Art)
FIG. 1 is a schematic circuit diagram showing a prior art circuit which controls the LED brightness in a digital manner.
Figure 2:
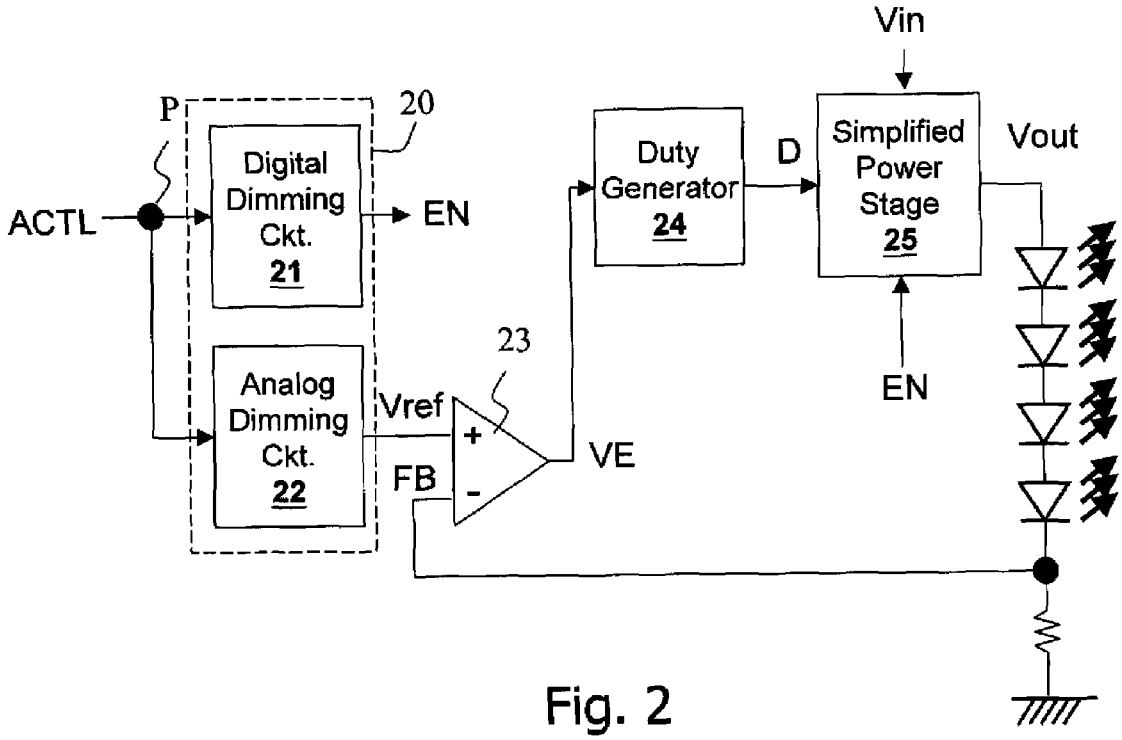
FIG. 2 is a schematic circuit diagram showing an embodiment of the present invention.

FIG. 2 is a schematic circuit diagram showing an embodiment according to the present invention. As shown in the figure, one single input signal ACTL is used in this invention to generate a digital signal EN and an analog signal Vref. Thus, if the LED driver circuit is an integrated circuit, only one pin P is required.

More specifically, in this embodiment, a digital dimming circuit 21 receives the input signal ACTL and generate the digital signal EN; an analog dimming circuit 22 receives the analog control signal ACTL and generate the analog signal Vref. The digital dimming circuit 21 and the analog dimming circuit 22 can be taken as one unit, i.e., a digital and analog dimming circuit 20. The analog signal Vref is compared with a feedback signal FB in an error amplifier 23, to generate an analog error signal VE. The analog error signal VE is inputted to a duty generator 24, which generates a duty signal D that drives a simplified power stage 25 to convert a supply voltage Vin to an output voltage Vout. The output voltage Vout is supplied to the LEDs. The duty generator 24 may be embodied in various ways; for example, it can be a pulse width modulation circuit. In one embodiment, the simplified power stage 25 is controlled by the digital signal EN; it operates only when the digital signal EN enables it. The simplified power stage 25 for example may be a buck converter, boost converter, buck-boost converter, inverter, fly-back converter, etc., as shown in FIGS. 10A-10G. The operation of such circuits are well known to those skilled in this art, and therefore they are not redundantly explained here.

Figure 3:
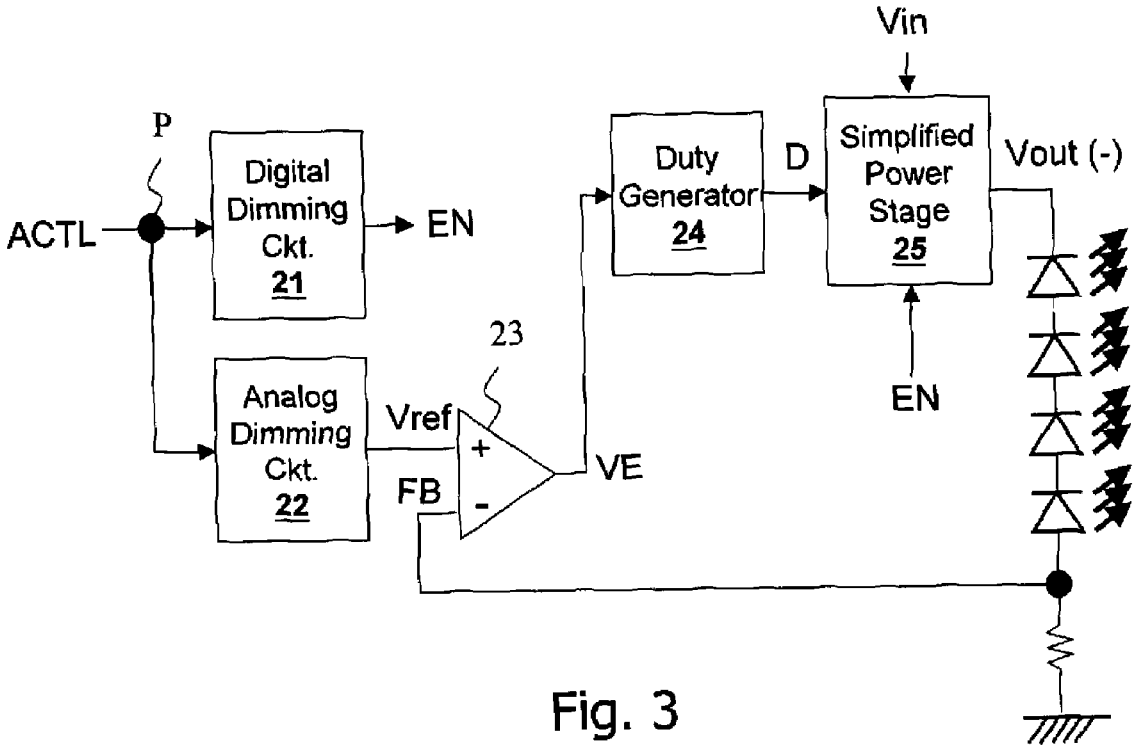
FIG. 3 shows another embodiment of the present invention.

In certain applications, the LEDs are connected in a reverse direction, and the simplified power stage 25 needs to output a negative voltage. FIG. 3 shows such an embodiment. The rest of the circuit is similar to that of the previous embodiment.

Figure 4:
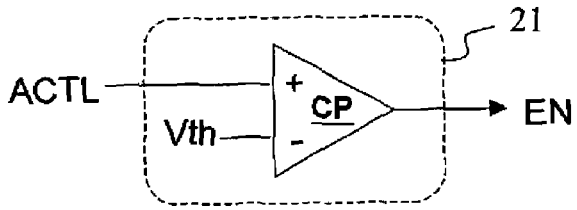
FIG. 4 shows an example of the digital dimming circuit.

The digital dimming circuit 21 generates the digital signal EN according to the input signal ACTL. FIG. 4 shows an embodiment of the digital dimming circuit 21. The input signal ACTL is compared with a reference voltage Vth in a comparator CP; when the input signal ACTL is higher than the reference voltage Vth, the comparator CP outputs a high-level signal, and when the input signal ACTL is lower than the reference voltage Vth, the comparator CP outputs a low-level signal.

Figure 11:
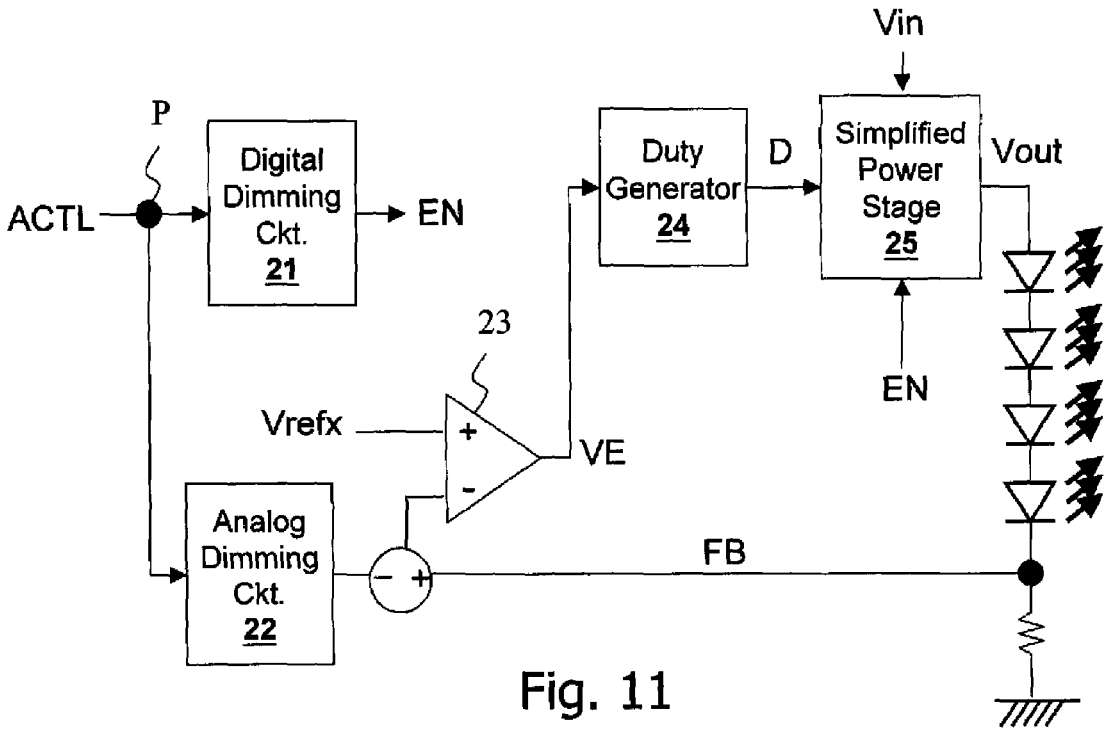
FIGS. 11 and 12 show two further embodiments of the present invention.
Figure 12:
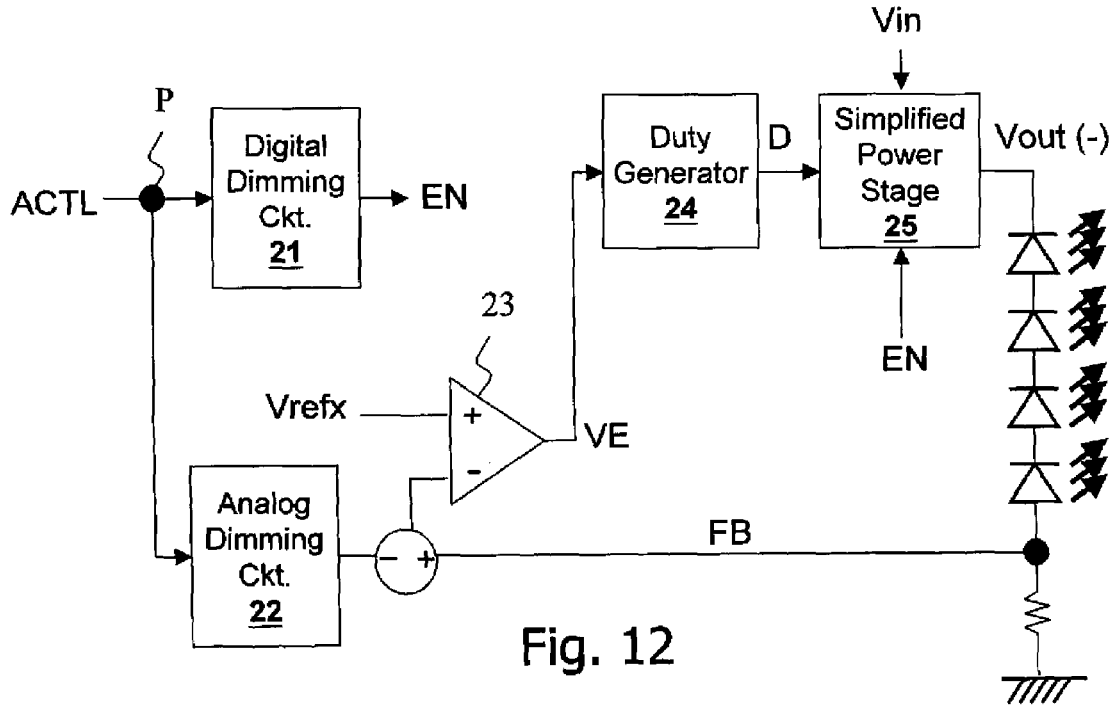

The function of the analog dimming circuit 22 is to generate a signal according to the input signal ACTL, and the signal should be capable of controlling the error amplifier 23 to generate a proper analog error signal VE. In the embodiments of FIGS. 2 and 3, the analog dimming circuit 22 receives the input signal ACTL and generates the analog signal Vref, which is sent to the positive input of the error amplifier 23; however, this is not the only arrangement to embody the present invention. As alternatives, referring to FIGS. 11 and 12, it can be arranged so that the negative output of the analog dimming circuit 22 is added with the feedback signal FB, and the result thereof is inputted to the negative input of the error amplifier 23, to be compared with a fixed reference voltage Vrefx inputted to the positive input of the error amplifier 23. A similar effect can also be achieved by such arrangements.

The following description is based on the analog dimming circuit 22 shown in FIGS. 2 and 3. However, under the teachings of the present invention, those skilled in this art can apply the same concept to other arrangements of the analog dimming circuit 22.

Figure 5:
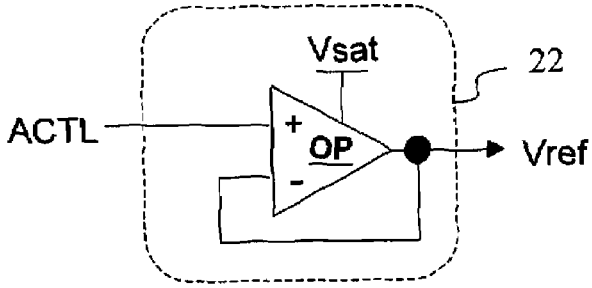
FIG. 5 shows an example of the analog dimming circuit.

FIG. 5 shows one embodiment of the analog dimming circuit 22. In this embodiment, the analog dimming circuit 22 includes an operational amplifier OP, which is supplied with a predefined working voltage Vsat. In other words, the operational amplifier OP also acts as a clamping circuit; under the working voltage Vsat, its output Vref follows the input signal ACTL, but when the input signal ACTL is higher than the working voltage Vsat, the output Vref will be kept as a constant Vsat.

Figure 8:
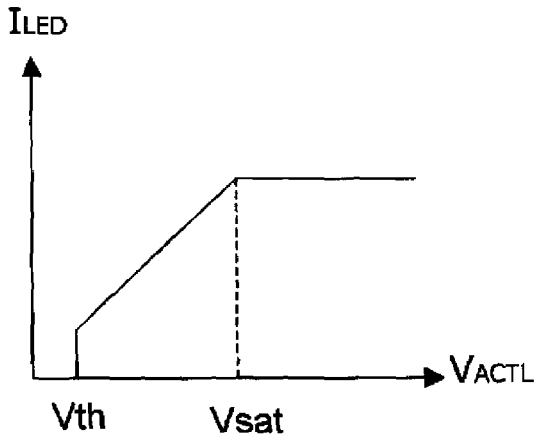
FIG. 8 shows the relationship between the input voltage $V_{ACTL}$ and the output current $I_{LED}$ of the overall circuit when employing the analog dimming circuit of FIG. 5.

When using the analog dimming circuit 22 as shown in FIG. 5, the relationship of the input voltage (i.e., the voltage of the input signal ACTL, $V_{ACTL}$) and the output current (i.e., the current flowing through the LEDs, $I_{LED}$) of the overall circuit is shown in FIG. 8. When the input voltage $V_{ACTL}$ is lower than the reference voltage Vth, the digital signal EN is low, and the simplified power stage 25 is thus inoperative; the output current is zero. When the input voltage $V_{ACTL}$ is higher than the reference voltage Vth, but lower than the voltage limit Vsat, the output current is approximately proportional to the input voltage. When the input voltage $V_{ACTL}$ is higher than the voltage limit Vsat, the output current is a constant. This provides an over current protection function for the output current.

In the above embodiment, any input voltage lower than the reference voltage Vth will not be able to provide any analog dimming function; that is, the brightness of the LEDs can not be adjusted below a certain extremely low range. It is OK because such extremely low range is not perceptible by human eyes. But in case it is necessary to do so, the analog dimming circuit 22 can be embodied as shown in FIG. 6 or FIG. 7.

Figure 6:
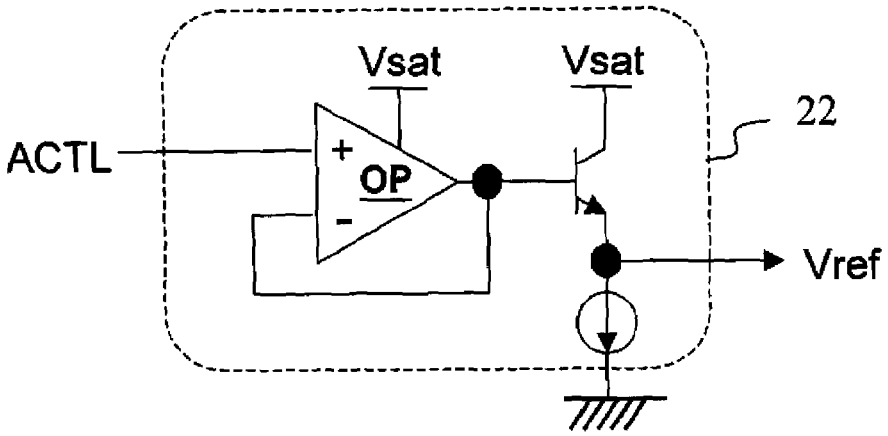
FIGS. 6 and 7 show two more examples of the analog dimming circuit.
Figure 7:
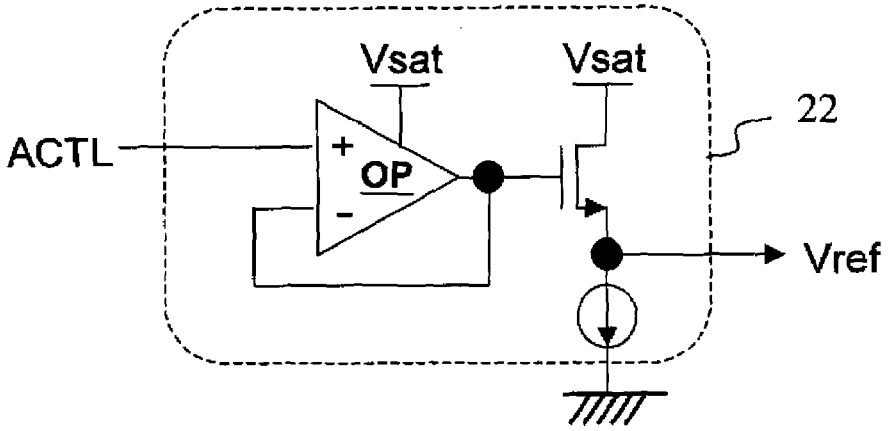
Figure 9:
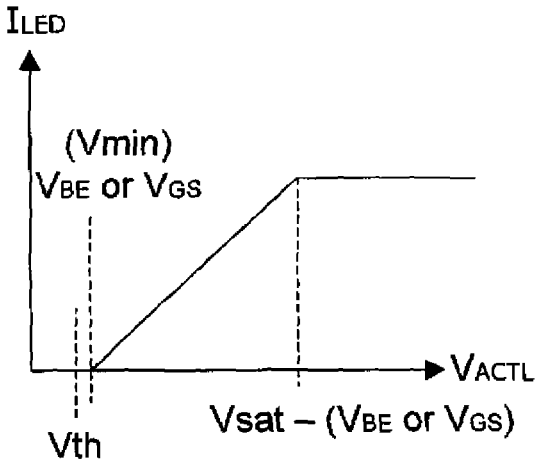
FIG. 9 shows the relationship between the input voltage $V_{ACTL}$ and the output current $I_{LED}$ of the overall circuit when employing the analog dimming circuit of FIG. 6 or FIG. 7.
Figure 10A:
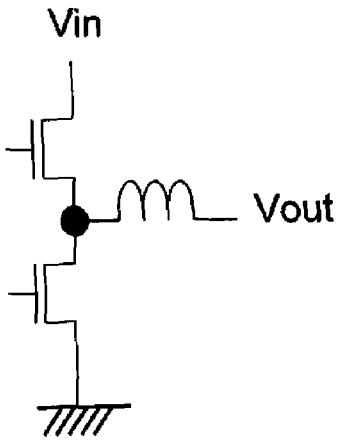
FIGS. 10A-10G show several examples of the simplified power stage.
Figure 10B:
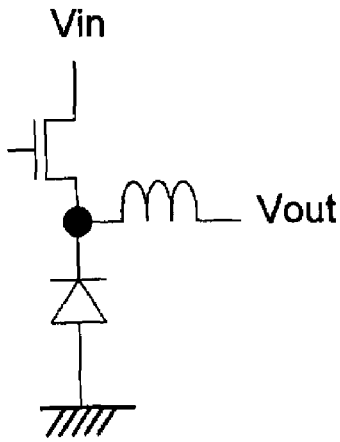
Figure 10C:
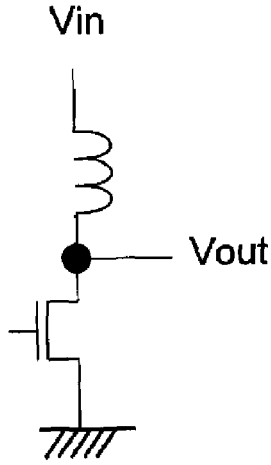
Figure 10D:
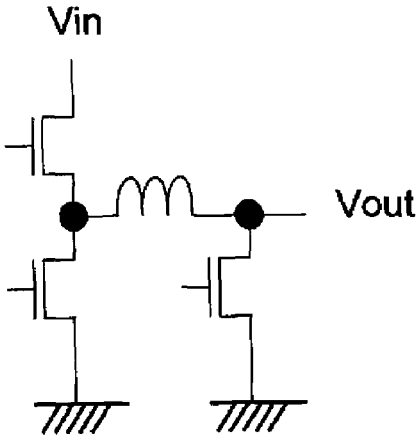
Figure 10E:
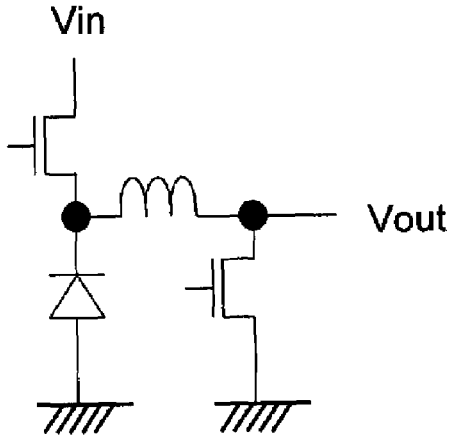
Figure 10F:
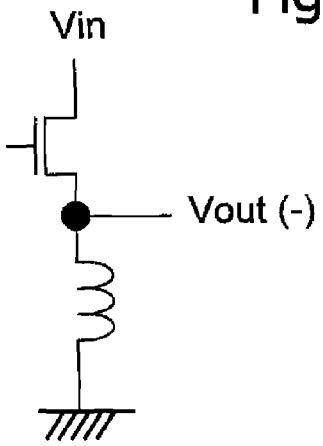
Figure 10G:
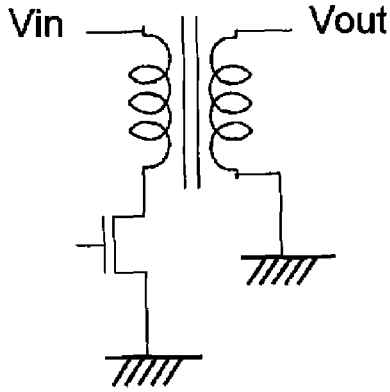

In the analog dimming circuit 22 shown in FIG. 6, there is a voltage drop $V_{EE}$ between the operational amplifier OP and the output Vref of the circuit, and thus the upper limit of the voltage Vref is decreased and becomes Vsat-$V_{BE}$. Similarly, in the circuit of FIG. 7, the upper limit of the voltage Vref is decreased and becomes Vsat-$V_{GS}$. The relationship of the input voltage $V_{ACTL}$ and the output current $I_{LED}$ of the overall circuit is shown in FIG. 9. The output current $I_{LED}$ can only be generated when the input voltage $V_{ACTL}$ is larger than $V_{BE}$ or $V_{GS}$ (the lower limit Vmin); however, because Vmin is larger than zero, if the reference voltage Vth is set below Vmin ($V_{BE}$ or $V_{GS}$ in this case), the output current $I_{LED}$ can be adjustable even in an extremely low range. In other words, the LED brightness can be adjusted even in an extremely low range. When the input voltage $V_{ACTL}$ is higher than $V_{BE}$ or $V_{GS}$, but lower than the upper limit Vsat−$V_{BE}$ (or Vsat−$V_{GS}$), the output current approximately proportional to the input voltage. When the input voltage $V_{ACTL}$ is higher than the upper limit Vsat–$V_{BE}$ (or Vsat–$V_{GS}$), the output current is a constant. Thus, the overall circuit not only provides the over current protection function, but also provides brightness adjustment function in an extremely low range.

The foregoing description describes the present invention from a perspective that the input signal ACTL is expected to be an analog signal. However, one can see that the input signal ACTL can be a digital dimming signal, and in this case the circuit can readily provide digital dimming function. Taking the circuit shown in FIG. 2 as an example (the same is true for the circuits shown in other figures), digital dimming function can be achieved by inputting a digital dimming signal to the pin P, as long as the low level of the digital signal is below a predetermined lower limit, such as Vth in FIG. 8 or $V_{BE}$ or $V_{GS}$ in FIG. 9.

Figure 13:
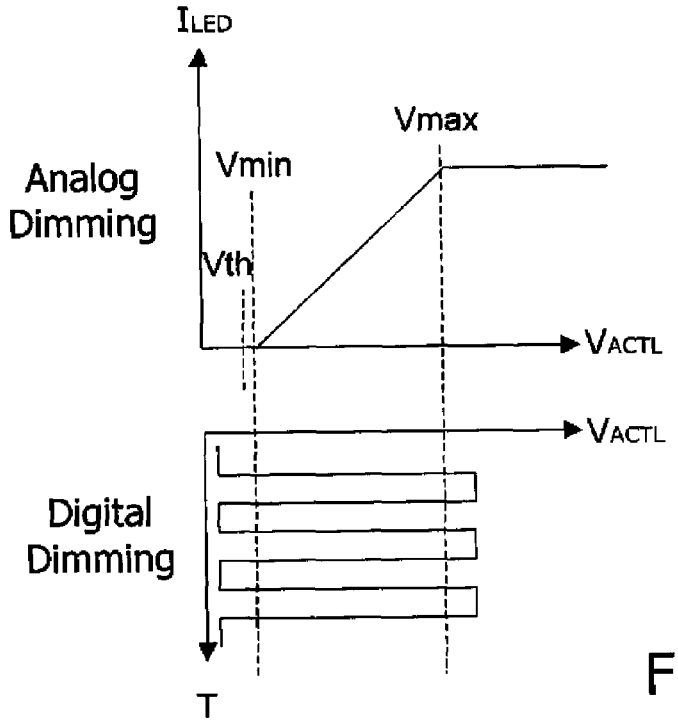
FIG. 13 explains the relationships among the input voltage $V_{ACTL}$, the analog dimming function, the digital dimming function, and the enable function.

More specifically, referring to FIG. 13 in conjunction with FIG. 2, the input signal ACTL can be an analog signal or a digital signal, depending on where the dimming control circuit is applied to. When the input signal ACTL is an analog signal, its maximum effective value for brightness control is Vmax (this upper limit for example may be Vsat–$V_{BE}$ or Vsat–$V_{GS}$ in FIG. 9); its minimum effective value for brightness control is Vmin (this lower limit for example may be $V_{BE}$ or $V_{GS}$ in FIG. 9); and the threshold to enable the control circuit is Vth. When the input signal ACTL is a digital signal, the duty ratio of the digital input signal ACTL decides the LED brightness. That is, when the input voltage $V_{ACTL}$ is lower than the voltage Vmin, the LEDs do not shine; when the input voltage $V_{ACTL}$ is higher than the voltage Vmin, the LEDs shine. The average brightness of the LEDs is decided by the brightness of the LEDs when they shine and the duty ratio of the digital input signal ACTL. Certainly, when the input signal ACTL is a digital signal, its high level should preferably be larger than the upper limit Vmax such that the LED brightness can be adjusted in full span. Otherwise, the maximum brightness of the LEDs will be limited by the high level of the input signal ACTL.

Figure 14:
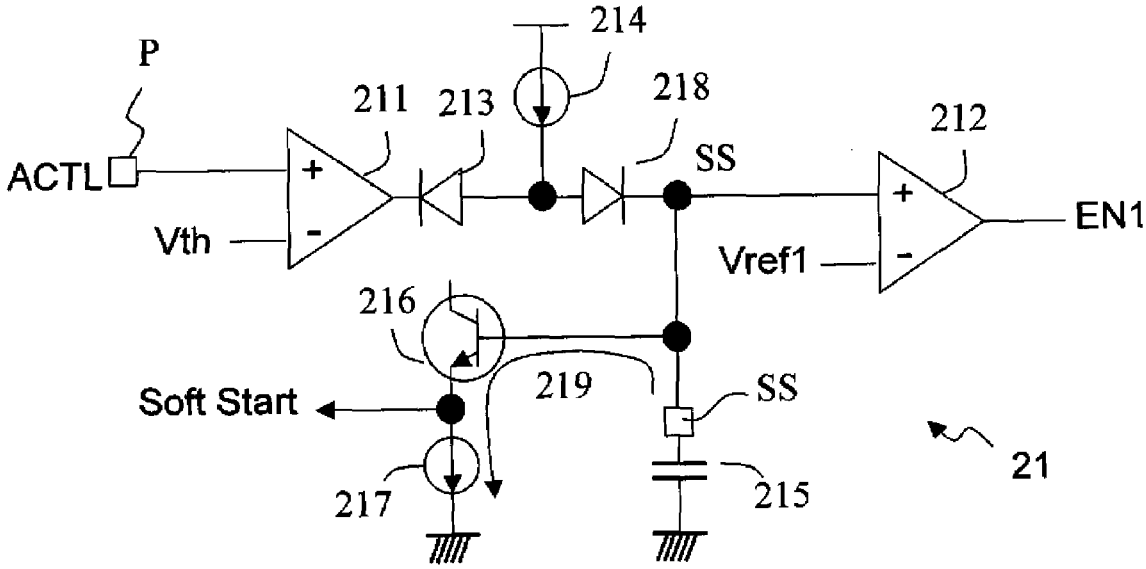
FIG. 14 shows another example of the digital dimming circuit.

FIG. 14 shows another embodiment of the digital dimming circuit 21, which includes a soft start control function. As shown in the figure, at circuit start-up stage, a current source 214 charges a capacitor 215; the charges accumulated on the capacitor 215 can be used to provide the desired soft start function. The soft start function is fully disabled when the capacitor 215 is charged to its full extent, and resumes when the capacitor 215 is fully discharged. When the current source 214 charges the capacitor 215, from one aspect, it begins or restarts to disable the soft start function. The charges accumulated on the capacitor 215 can be used in various ways to provide the desired soft start function. For example, in the shown embodiment, a bipolar transistor 216 is provided whose base is connected to the node SS, emitter connected with a current source 217, and collector connected to a low-impedance node (not shown) in the control circuit. Thus, by means of the level following effect by the bipolar transistor 216, the voltage level at the node SS can be duplicated to a desired location in the control circuit to soft-starting a device. What is described above is only one example for soft start; those skilled in this art can make use of the charges accumulated on the capacitor 215 in various ways under the teachings of the present invention.

A comparator 211 (which can be a normal comparator or a hysteric comparator) compares the input signal ACTL with the reference voltage vth. When the input signal ACTL is lower than the reference voltage Vth, the output of the comparator 211 is low; the current from the current source 214 flows through a diode 213 and the grounding path of the comparator 211 (not shown) to ground, so it does not charge the capacitor 215. The capacitor 215 slowly discharges through the bipolar transistor 216. Due to the current multiplying effect of the bipolar transistor 216 (in a reverse way), the discharging current will be a certain ratio of the current source 217, so the capacitor 215 will not discharge quickly. After the capacitor 215 discharge to a certain extent, the soft start function resumes.

The voltage level at the node SS slowly decreases as the capacitor 215 discharges. When the voltage level at the node SS becomes lower than the reference voltage Vref1, the comparator 212 outputs a low level signal EN1 to shut down the control circuit. The value of the reference voltage Vref1 may be decided according to circuit shut down requirements. For example, assuming that it is required to shut down the control circuit after a period of time from when the input signal ACTL switches to low, then the value of the reference voltage Vref1 can be decided according to the voltage of the capacitor 215 and the length of the time period. In other words, the capacitor 215, the discharge path 219 and the comparator 212 form a delay circuit for generating a delayed shut down signal to shut down the control circuit after a predetermined period of time from when the input signal ACTL switches to low. Note that the bipolar transistor 216 and the current source 217 are shown in the figure as an example for providing the soft start function, as described above. For the function of the delay circuit, they are not required in the discharge path 219; the capacitor 215 can discharge in any manner. The comparator 212 can be a normal comparator or a hysteric comparator. The signal EN1 can be used as the enable signal EN in FIGS. 2, 3, 11 and 12; or, the enable signal EN can be taken from the output of the comparator 211, and the signal EN1 is used for a different function.

Although the present invention has been described in considerable detail with reference to certain preferred embodiments, these embodiments are for illustrative purpose and not for limiting the scope of the present invention. Other variations and modifications are possible. For example, the present invention can be applied to not only the dimming circuit, but also all applications which requires to generate both digital and analog signals from one single input signal. As another example, in all of the embodiments, one can insert a circuit which does not affect the primary function of the overall circuit, between any two devices which are shown to be in direct connection. As a further example, the voltage drop can be achieved by various ways other than those shown in FIGS. 6 and 7. Therefore, all modifications and variations based on the spirit of the present invention should be interpreted to fall within the scope of the following claims and their equivalents.

What is claimed is:

1. A dimming control circuit, comprising:

an input terminal for receiving an input signal;

a digital dimming circuit for receiving the input signal and generating a digital signal;

an analog dimming circuit for receiving the input signal and generating an analog signal; and a power circuit for converting a supply voltage to an output voltage according to the analog signal generated by the analog dimming circuit; and a soft-start control circuit coupled to the digital signal, for disabling a soft-start signal to be generated when the digital signal switches from a first logic state to a second logic state and switches back to the first logic state while the second logic state lasts shorter than a predetermined period of time, and enabling generation of the soft-start signal when the digital signal switches from the second logic state to the first logic state after the digital signal stays at the second logic state for the predetermined period of time.

2. The dimming control circuit of claim 1, wherein the soft-start control circuit further compares the soft-start signal with a reference voltage to generate an enable signal.

3. The dimming control circuit of claim 1, wherein the analog dimming circuit includes an operational amplifier which compares the input signal with the output of the operational amplifier.

4. The dimming control circuit of claim 3, wherein the operational amplifier is supplied with a predefined working voltage.

5. The dimming control circuit of claim 3, wherein the output of the operational amplifier is decreased by a voltage level, and the voltage-decreased signal is supplied as the output of the analog dimming circuit.

6. The dimming control circuit of claim 5, wherein the digital dimming circuit includes a comparator which compares the input signal with a first reference voltage, and wherein the voltage level by which the output of the operational amplifier is decreased is higher than the first reference voltage.

7. The dimming control circuit of claim 1, wherein the power circuit includes an error amplifier having one end receiving the analog signal generated by the analog dimming circuit, and the other end receiving a feedback signal which is relevant to the output voltage.

8. The dimming control circuit of claim 1, wherein the power circuit includes an error amplifier having one end receiving a second reference voltage, and the other end receiving a difference between the analog signal generated by the analog dimming circuit and a feedback signal which is relevant to the output voltage.

9. A dimming control circuit, comprising:

an input terminal for receiving an input signal;

a digital dimming circuit for receiving the input signal and generating a digital signal;

an analog dimming circuit for receiving and generating an analog signal; and a power circuit for converting a supply voltage to an output voltage according to the analog signal generated by the analog dimming circuit, wherein the digital dimming circuit includes;

a first comparator comparing the input signal with a first reference voltage;

a soft start device generating a voltage at a node, the soft start device being electrically connected with the output of the first comparator; and a second comparator comparing the voltage at the node with a second reference voltage and outputting a first enable signal.

10. The dimming control circuit of claim 9, wherein the first comparator outputs a second enable signal.

11. The dimming control circuit of claim 9, wherein the soft start device includes:

a first current source; and a capacitor charged by the first current source to generate the voltage at the node.

12. The dimming control circuit of claim 11, wherein the soft start device further comprises a bipolar transistor having a collector electrically connected with one end of the capacitor, and an emitter providing a soft start signal.

13. The dimming control circuit of claim 12, wherein the soft start device further comprises a second current source electrically connected with the emitter of the bipolar transistor.

14. A dimming control circuit, comprising:

an input terminal for receiving an input signal;

an analog and digital dimming circuit receiving the input signal, wherein the analog and digital dimming circuit provides an analog dimming function when a voltage level of the input signal is between a predetermined lower limit and a predetermined upper limit, and a digital dimming function when the voltage level of the input signal switches above and below the predetermined lower limit, and wherein the analog and digital dimming circuit generates an analog signal when the voltage level of the input signal is above the predetermined lower limit; and a power circuit for supplying an output current in correspondence to the analog signal generated by the analog and digital dimming circuit.

15. The dimming control circuit of claim 14, further comprising a delay circuit for generating a delayed shut down signal after a predetermined period of time from when the input signal stays below a predetermined voltage level which is lower than or equal to the predetermined lower limit.

16. The dimming control circuit of claim 14, wherein when the voltage level of the input signal switches above and below the predetermined lower limit, the high level of the input signal is higher than the predetermined higher limit.

17. The dimming control circuit of claim 14, wherein when the voltage level of the input signal is below the predetermined lower limit, the output current from the power circuit is substantially zero.

18. The dimming control circuit of claim 17, wherein the predetermined lower limit is higher than zero.

19. The dimming control circuit of claim 14, further comprising a soft start control circuit which begins or restarts to disable a soft start function when the input signal switches above the predetermined lower limit, and resumes the soft start function when the input signal stays below a predetermined voltage level which is lower than or equal to the predetermined lower limit for a predetermined period of time.

20. The dimming control circuit of claim 19, wherein the soft start control circuit includes a current source charging a capacitor, the charges on the capacitor provide the soft start function, and wherein the capacitor discharges when the voltage level of the input signal is below a predetermined voltage level which is lower than or equal to the predetermined lower limit.

* * * * *